US007255593B2

(12) United States Patent
Tyler

(10) Patent No.: US 7,255,593 B2
(45) Date of Patent: Aug. 14, 2007

(54) ELECTRICAL CONNECTOR WITH CONNECTOR POSITION ASSURANCE (CPA) MEMBER

(75) Inventor: Adam P. Tyler, Rochester Hills, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/328,787

(22) Filed: Jan. 9, 2006

(65) Prior Publication Data

US 2007/0161284 A1 Jul. 12, 2007

(51) Int. Cl.
*H01R 3/00* (2006.01)

(52) U.S. Cl. ..... 439/489; 439/352

(58) Field of Classification Search ..... 439/352, 439/489

See application file for complete search history.

(56) References Cited

U.S. PATENT DOCUMENTS 6,332,804 B2 * 12/2001 Kurimoto et al. ..... 439/489
6,716,052 B2 * 4/2004 Kane ..... 439/352
6,824,417 B1 * 11/2004 Nimura ..... 439/352
6,857,892 B2 * 2/2005 McLauchlan et al. ..... 439/352
6,896,538 B2 * 5/2005 Grubbs ..... 439/352
6,921,279 B2 7/2005 Sian et al. ..... 439/352
2002/0004333 A1 * 1/2002 Fukase ..... 439/489

OTHER PUBLICATIONS

Product Brochure "APEX 150 Coupling connectors", Jul. 2005, 1 page.

* cited by examiner

*Primary Examiner*—Tho D. Ta
(74) *Attorney, Agent, or Firm*—Harrington & Smith, PC

(57) ABSTRACT

An electrical connector including at least one electrical contact, a housing, and a connector position assurance (CPA) member. The housing has a latch for latching the housing to a mating electrical connector. The electrical contact is located in the housing. The CPA member is connected to the housing and is adapted to prevent the latch from moving when the housing is mated with the mating electrical connector. The CPA member is adapted to move the latch after the housing is mated with the mating electrical connector.

25 Claims, 10 Drawing Sheets

ELECTRICAL CONNECTOR WITH CONNECTOR POSITION ASSURANCE (CPA) MEMBER

BACKGROUND OF THE INVENTION

1. Field of the Invention

The invention relates to an electrical connector and, more particularly, to an electrical connector having a latch and a connector position assurance member.

2. Brief Description of Prior Developments

U.S. Pat. No. 6,921,279 B2 discloses an electrical connector with a connector position assurance (CPA) member. The connector has a housing with a deflectably latch. The latch has a rear finger contact section, a front cantilevered arm, and is adapted to pivot on the housing at a connection section. The CPA member is adapted to slide along the housing. U.S. Pat. No. 6,716,052 B2 discloses another type of CPA device.

There is a desire to reduce the overall size of electrical connectors which have a mating connector latch and CPA member. There is also a desire to provide a more ergonomic actuation surface on a CPA member without increasing the size of an electrical connector.

SUMMARY OF THE INVENTION

In accordance with one aspect of the invention, an electrical connector is provided including at least one electrical contact, a housing, and a connector position assurance (CPA) member. The housing has a latch for latching the housing to a mating electrical connector. The electrical contact is located in the housing. The CPA member is movably connected to the housing. In one position the CPA member is adapted to prevent the latch from moving when the housing is mated with the mating electrical connector. In another position the CPA member is adapted to move the latch after the housing is mated with the mating electrical connector.

In accordance with another aspect of the invention, an electrical connector is provided including at least one electrical contact; a housing and a connector position assurance (CPA) member. The housing has a latch for latching the housing to a mating electrical connector. The CPA member is connected to the housing and is adapted to pivot relative to the housing at pivot locations proximate a middle of the CPA member.

In accordance with another aspect of the invention, an electrical connector is provided comprising at least one electrical contact; a housing and a connector position assurance (CPA) member connected to the housing. The housing has a latch for latching the housing to a mating electrical connector. The latch comprises cantilevered lugs extending from opposite lateral sides of the latch. The CPA member is connected to the housing and contacts the lugs of the latch.

In accordance with another aspect of the invention, an electrical connector is provided comprising at least one electrical contact; a housing and a connector position assurance (CPA) member. The housing has a latch for latching the housing to a mating electrical connector. The CPA member is connected to the housing and is adapted to deflect the latch to disconnect the latch from the mating electrical connector.

In accordance with one method of the invention, a method of assembling an electrical connector is provided comprising inserting a connector position assurance (CPA) member into a housing of the electrical connector; locating laterally extending pivot lugs of the CPA member in grooves of the housing; and locating laterally extending connection lugs of a latch of the housing at contact surfaces of the CPA member.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
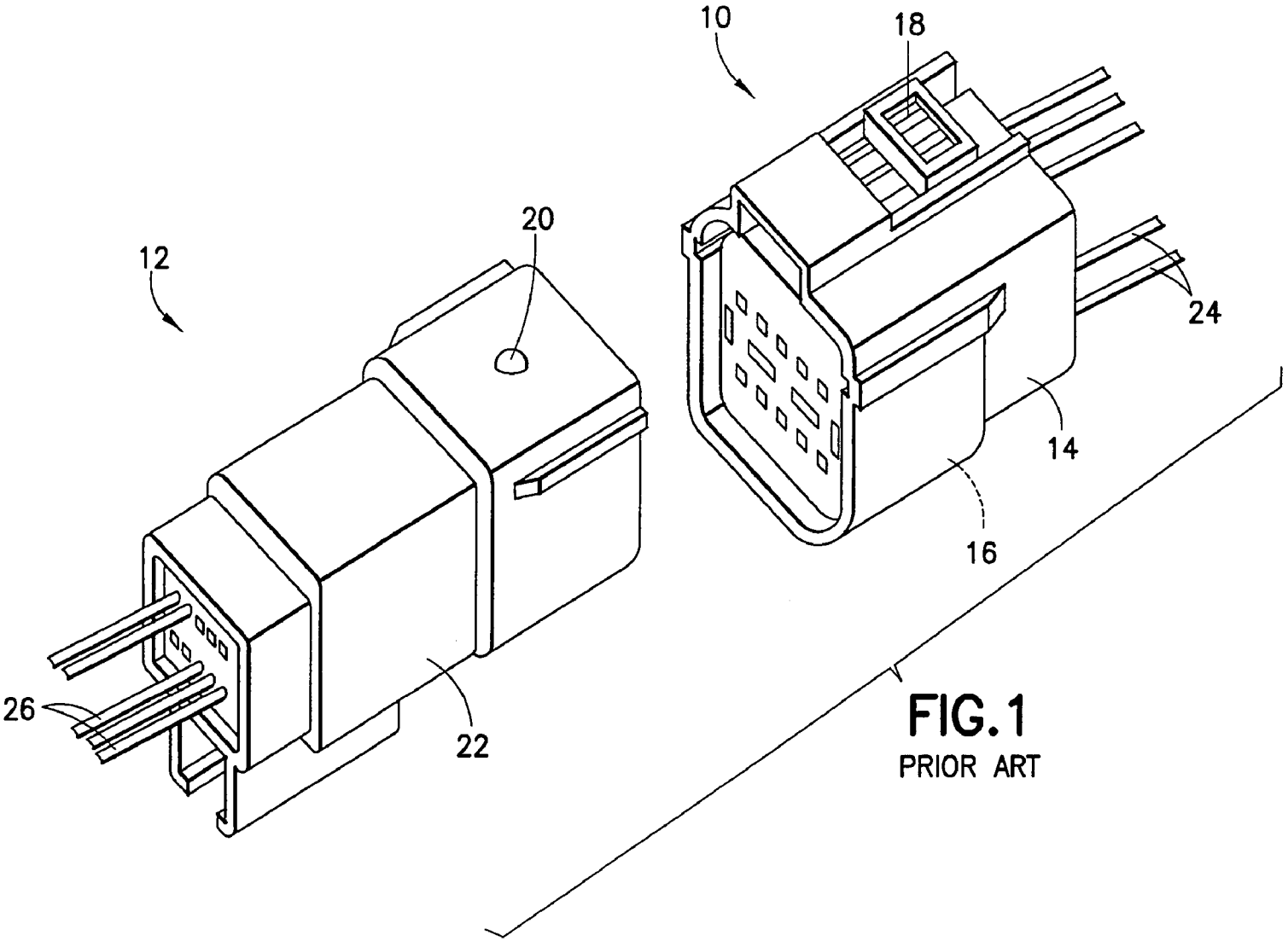
FIG. 1 PRIOR ART
FIG. 1 is a perspective view of conventional mating male and female electrical connectors.

Referring to FIG. 1, there is shown a perspective view of two conventional electrical connectors 10, 12 which are adapted to mate with each other. The two electrical connectors 10, 12 comprise APEX electrical connectors manufactured by FCI USA, Inc. The female electrical connector 10 comprises a housing 14, female electrical contacts 16, and a connector position assurance (CPA) member 18. The housing 14 has a snap-lock latch for latching with the latch 20 on the housing 22 of the male electrical connector. The two connectors 10, 12 allow the electrical wires 24, 26 to be removably connected to each other.

Figure 2:
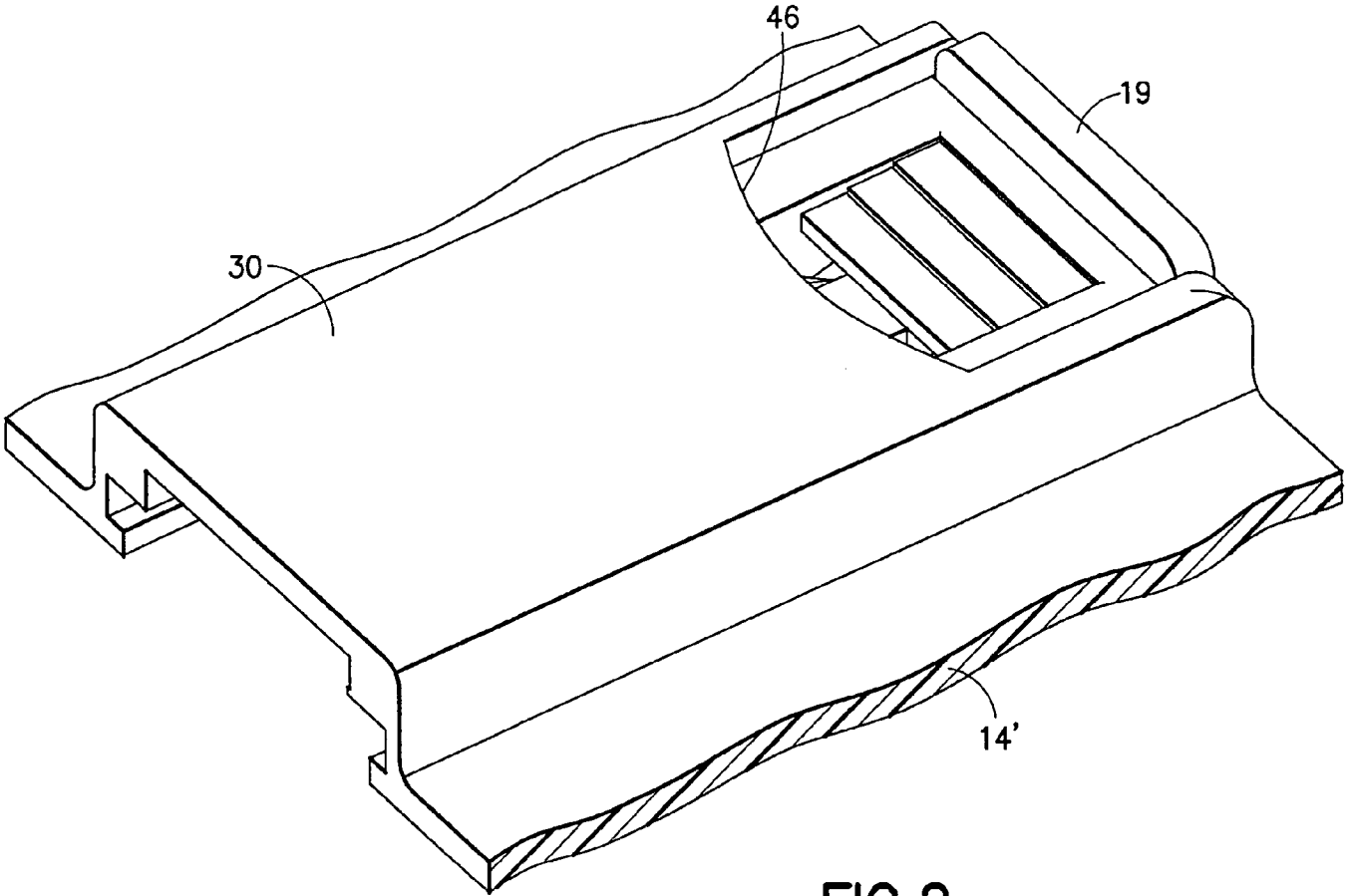
FIG. 2 is a perspective view of a portion of an electrical connector incorporating features of the invention.

Referring now also to FIG. 2, the electrical connector of the invention is identical to the female electrical connector 10 shown in FIG. 1 with the exception of the CPA member, and the portion of the housing at the CPA member including the housing latch as further described below. Although the invention will be described with reference to the exemplary embodiment shown in the drawings, it should be understood that the invention can be embodied in many alternate forms of embodiments. In addition, any suitable size, shape or type of elements or materials could be used.

Figure 3:
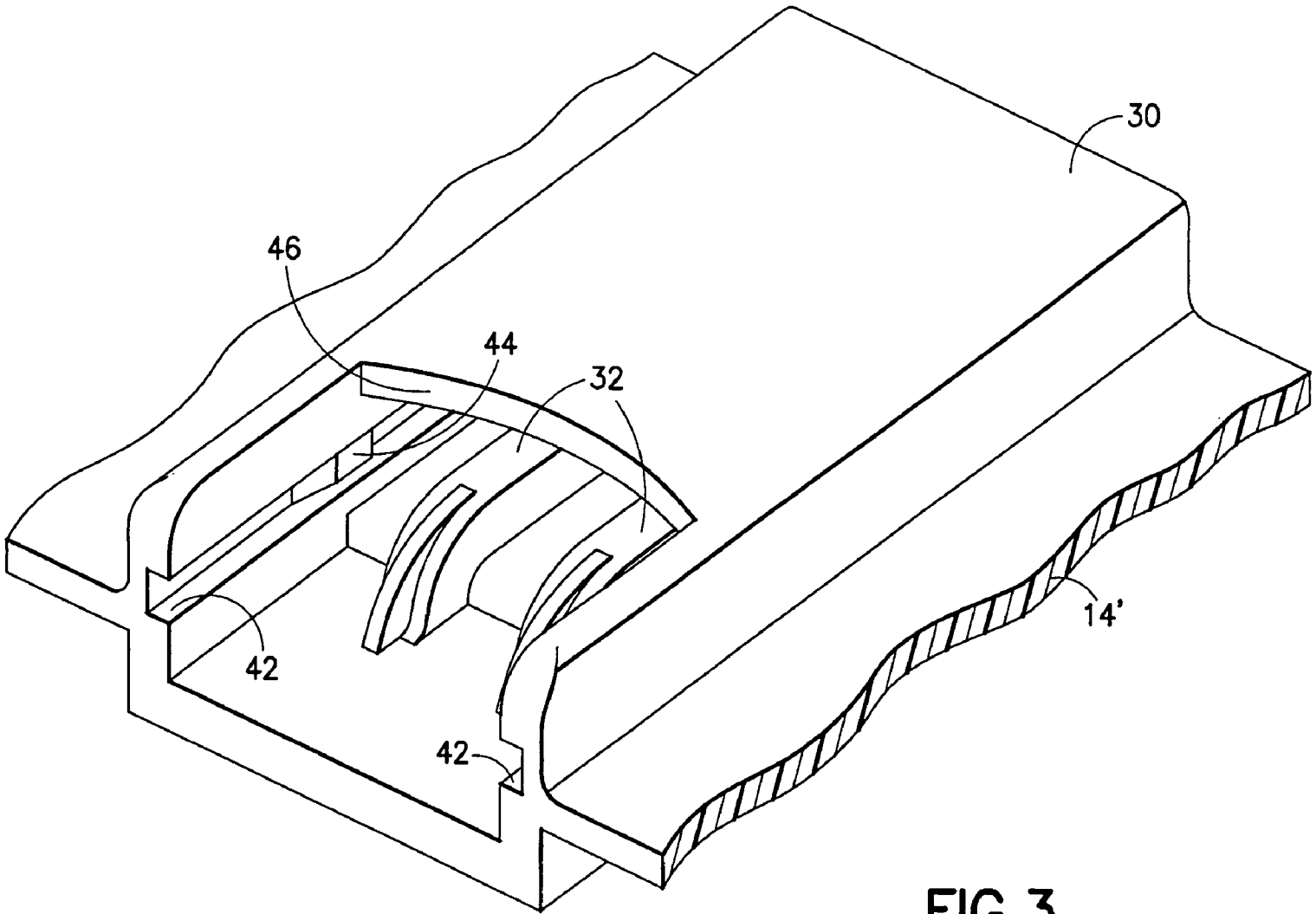
FIG. 3 is a perspective view of the portion of the electrical connector housing shown in FIG. 2.
Figure 4:
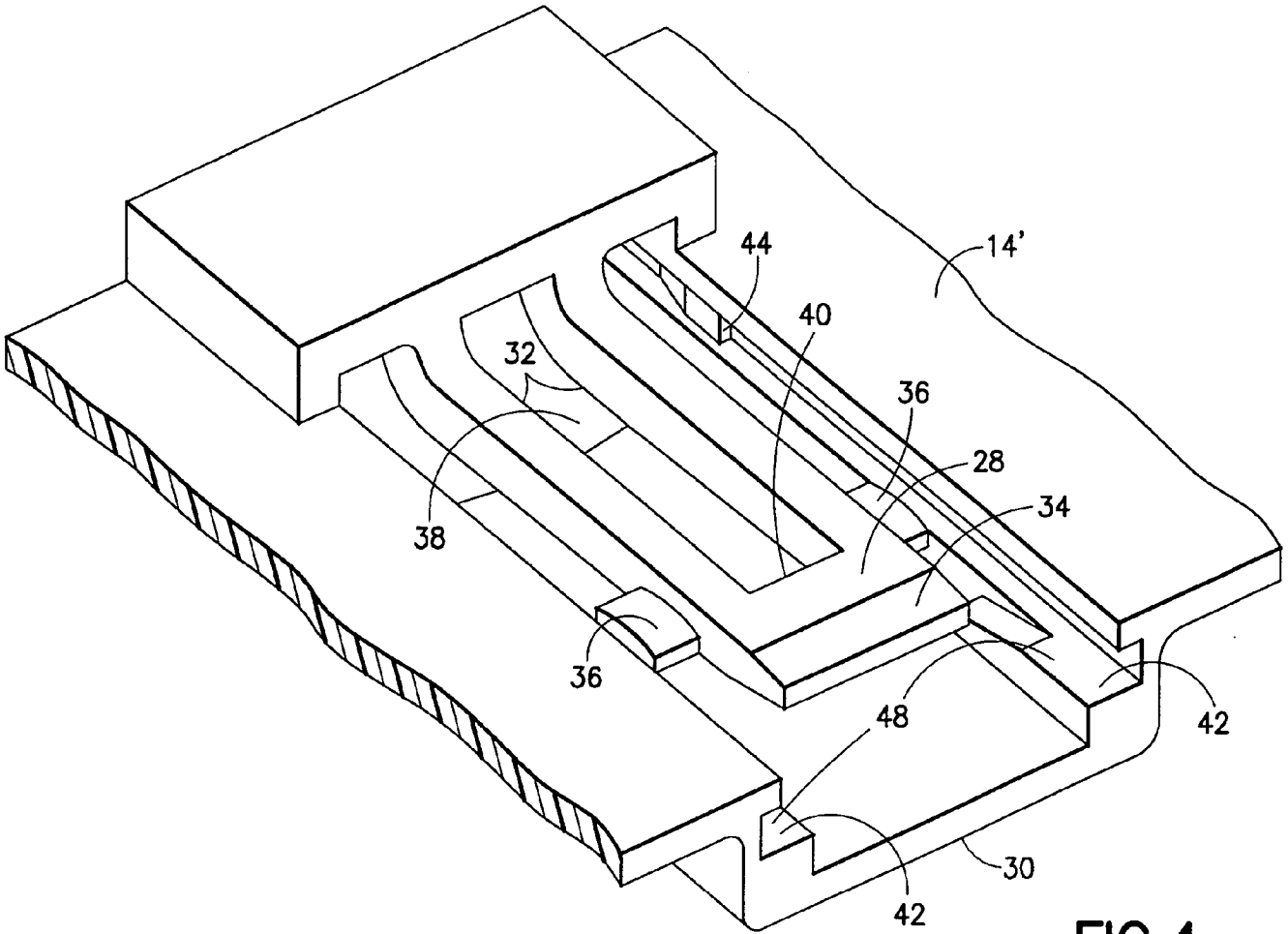
FIG. 4 is a perspective view of the portion of the electrical connector housing shown in FIG. 3 from a reverse direction.

Referring specifically to FIGS. 2-4, the housing 14' has a snap-lock latch 28 and a latch cover section 30. The housing 14' is preferably a one-piece member made of molded plastic or polymer material However, in alternate embodiments, the housing could be comprised of multiple members and different materials(s). The latch 28 comprises a member which projects forward in a general cantilevered fashion. The member comprises two arms 32, a bridge 34, and two lugs 36. A gap or receiving area 38 is formed between the two arms 32. The bridge 34 is located at the front ends of the arms 32 and forms a latch locking surface 40 adjacent the area 38. The lugs 36 extend laterally outward from the arms 32 in opposite directions.

The latch cover section 30 is slightly spaced from the latch 28 such that the latch 28 can resiliently deflect outward. The latch cover section 30 generally comprises side channels or grooves 42, a rear stop surface 44 at a back stop at the rear ends of the grooves 42, and a top rear opening 46 for a finger contact section of the CPA member 19 to move in. At the front ends of the grooves 42, the housing 14' has inward stop surfaces 48 at a top side of the cover section 30.

Figure 5:
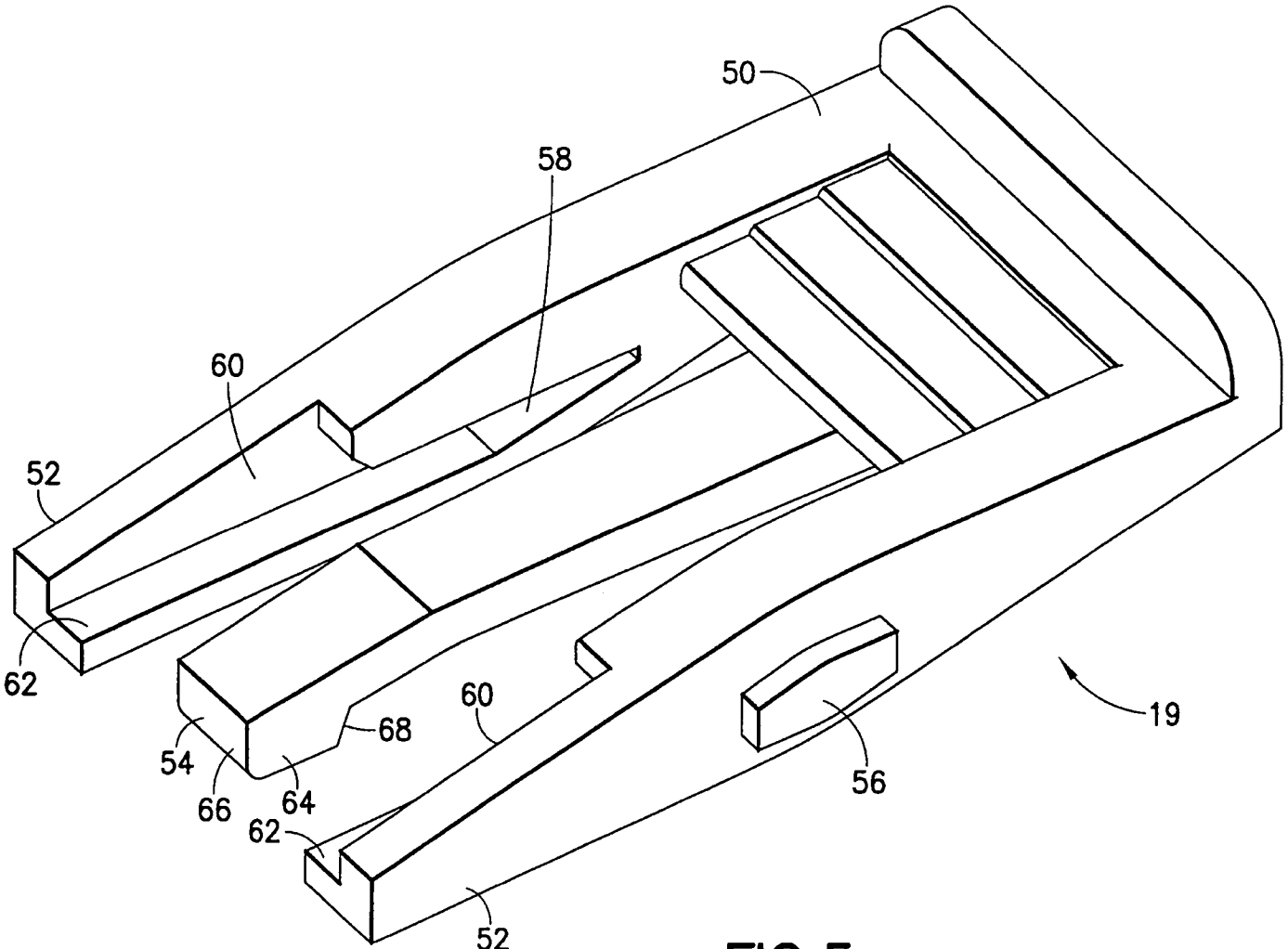
FIG. 5 is a front, top and side perspective view of the CPA member shown in FIG. 2.
Figure 6:
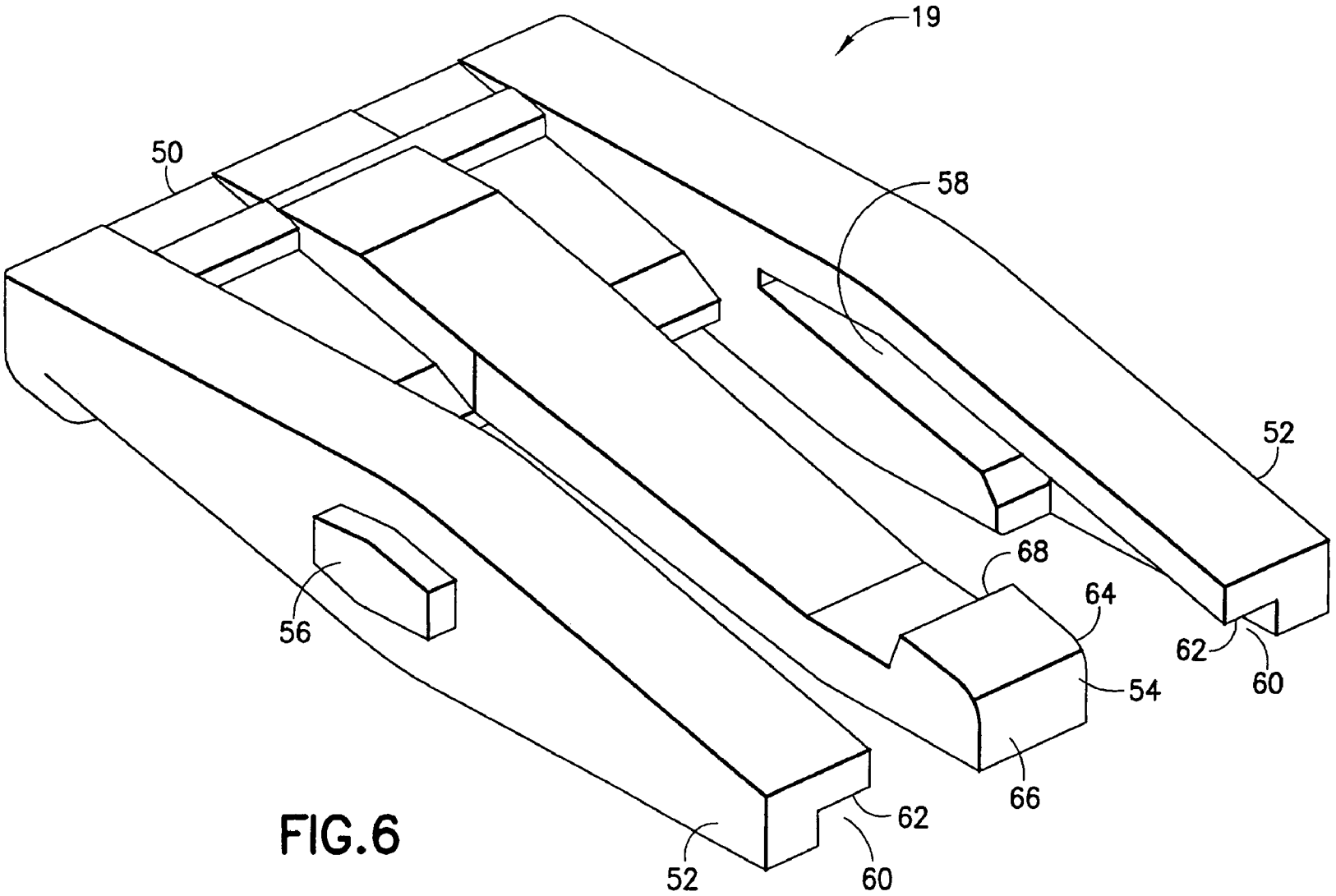
FIG. 6 is a front, bottom and side perspective view of the CPA member shown in FIG. 5.

Referring now also to FIGS. 5 and 6, the CPA member 19 is preferably a one-piece member comprised of molded plastic or polymer. However, in alternate embodiments, the CPA member could be comprised of multiple members and different materials(s). The CPA member 19 generally comprises a rear finger contact section 50, two side arms 52 and a center arm 54. As seen in FIG. 2, the rear finger contact section 50 is adapted to be located in the top rear opening 46 of the housing 14'.

The two side arms 52 extend forward from the rear finger contact section 50 in a general cantilevered fashion. The outer lateral sides of the arms 52 each comprise a lug 56. The lugs 56 are sized and shaped to slide and rotate in the grooves 42 of the housing 14'. The inner sides of the arms 52 each comprise a groove 58. The grooves 58 are sized and shaped to slideably receive the lugs 36 of the latch 28 therein. Fronts of the grooves 58 have an open top side 60 and a closed bottom side 62. As further described below, because the fronts of the grooves have an open top side 60 and a closed bottom side 62, when the CPA member is in an unlocked position, the latch 28 can move upward relative to the CPA member 19 and the CPA member can move the latch upward by moving the lugs 36 upward at the closed bottom side.

The center arm 54 also extends forward from the rear finger contact section 50 in a general cantilever fashion. The center arm 54 has a front head 64 with a front stop surface 66 and a rear catch surface 68. The center arm 54 is resiliently deflectable. The head 64 is sized and shaped to fit in the area 38 of the latch 28 with the front stop surface 66 against the rear locking surface 40 of the bridge 34.

Figure 7:
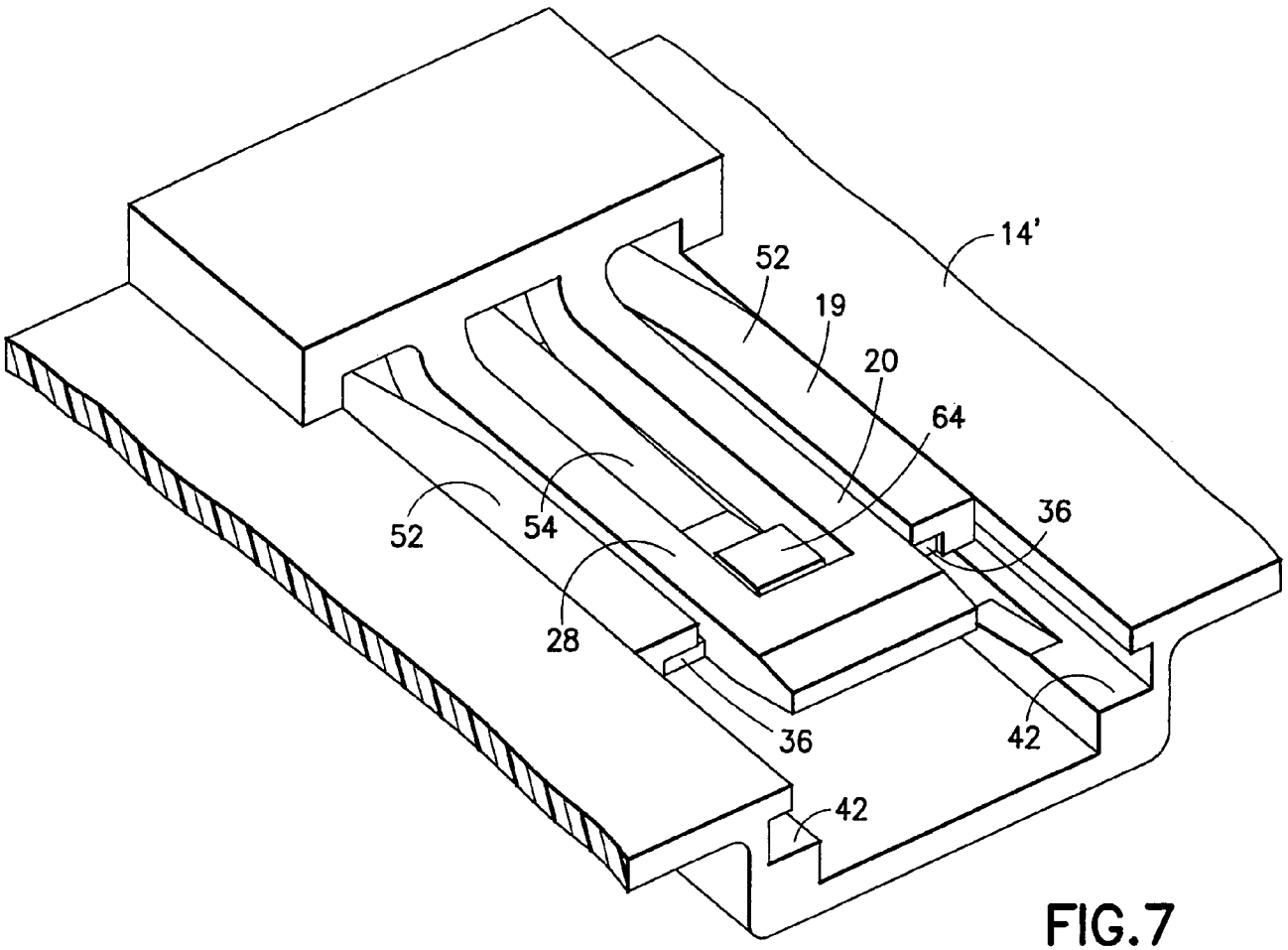
FIG. 7 is a perspective view as in FIG. 4 showing the CPA member connected to the housing at a neutral or unlocked position.

FIG. 7, similar to FIG. 2, shows the CPA member 19 connected to the housing 14' at a rear neutral or unlocked position. In this position, the finger contact section 50 is in a rear position. The arms 32 of the latch 28 are located in the areas between the arms 52, 54 of the CPA member 19. The head 64 of the CPA member's center arm 54 is located in the area 38 of the latch 28. Contact between the surfaces 66, 40 prevent the CPA member from moving forward on the housing 14'. Contact between the rear of the lugs 56 and the surfaces 44 prevent the CPA member from moving rearward on the housing 14'. The lugs 56 of the CPA member 19 are located in the rear of the grooves 42. The lugs 36 of the latch 28 are located at the front of the grooves 58 of the CPA member.

Figure 8:
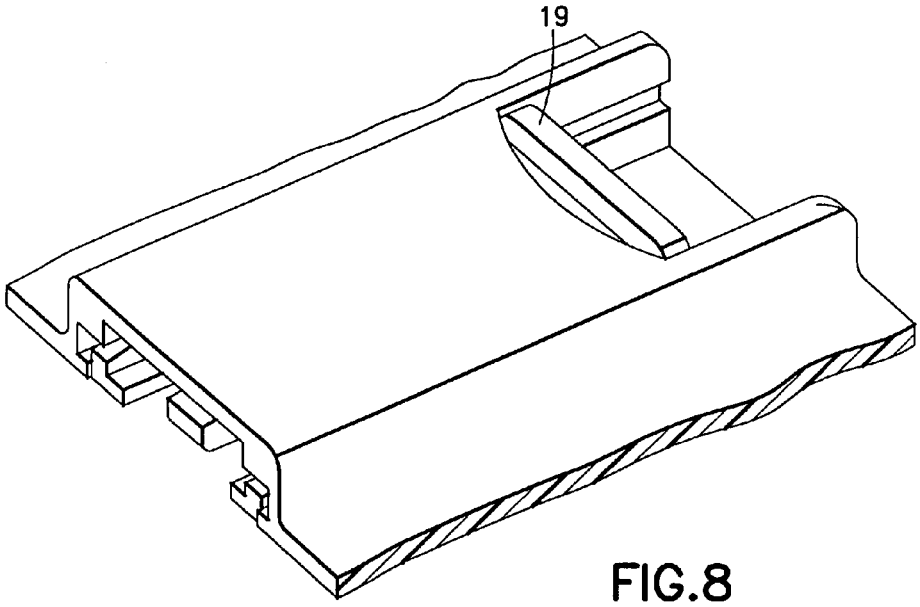
FIG. 8 is a top side perspective view as in FIG. 2 with the CPA member moved to a forward locked position.
Figure 9:
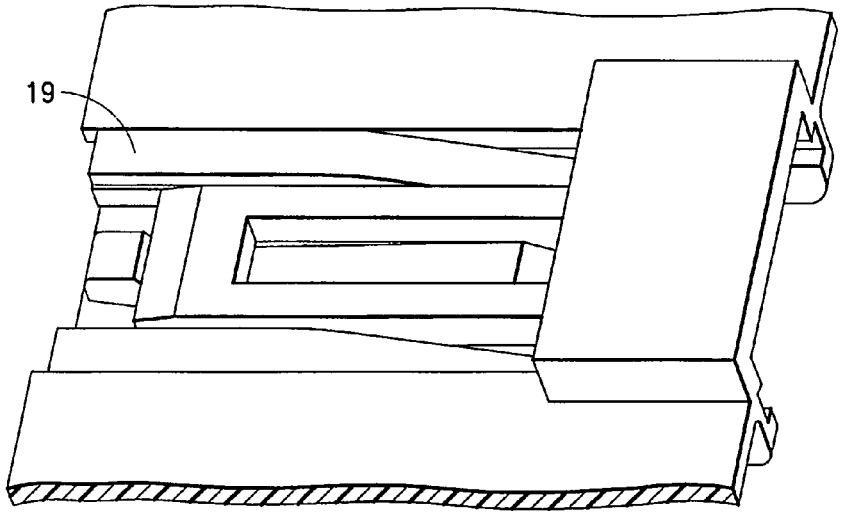
FIG. 9 is a bottom side perspective view of the CPA member and portion of the housing shown in FIG. 8.

Referring now to FIGS. 8 and 9, the CPA member 19 is shown at a forward locked position in the housing 14'. Because of the contact between the surfaces 40, 54 the CPA member 19 is prevented from being moved from the rear unlocked position to its forward locked position unless the female electrical connector is first connected to the male electrical connector 12. More specifically, the latch 20 on the housing 22 of the male electrical connector 12 is adapted to push the head 64 outwardly upward when the latch snaps into the area 38 behind the surface 40. This allows the center arm 54 to be pushed forward by a user past the bridge 34 of the latch 28 as the CPA member is pushed forward by the user. When the CPA member 19 reaches the forward locking position, the head 64 can snap down in front of the bridge 34. The surface 68, because of its contact with the front of the bridge 34, can then prevent the CPA member from being inadvertently moved rearward again.

When the CPA member 19 is moved forward on the housing 14', the lugs 56 of the CPA member 19 can longitudinally slide in the grooves 42 of the housing 14'. The CPA member 19 can also longitudinally slide with grooves 58 along lugs 36 of the latch 28. At the forward locked position, the closed top and bottom sides of the rear ends of the grooves 58 on the CPA member 19 prevent the latch 28 from moving outwardly upward relative to the rest of the housing. Therefore, the latch 28 is prevented from inadvertently disengaging from the latch 20 of the male electrical connector 12.

In order to disconnect the two electrical connectors from each other, the CPA member 19 must first be moved from its forward locked position to its rear unlocked position. The head 54 is moved outward to move the surface 68 off of the front surface of the bridge 34. The surface 68 is adapted to wedge the surface 68 off of the front surface of the bridge 34 as the finger contact section 50 is forceably moved rearward. After the CPA member 19 reaches its rearward unlocked position, the latch 28 still needs to be disengaged from the latch 20 on the mating electrical connector 12. In this embodiment, the CPA member 19 is adapted to accomplish this function.

Figure 10:
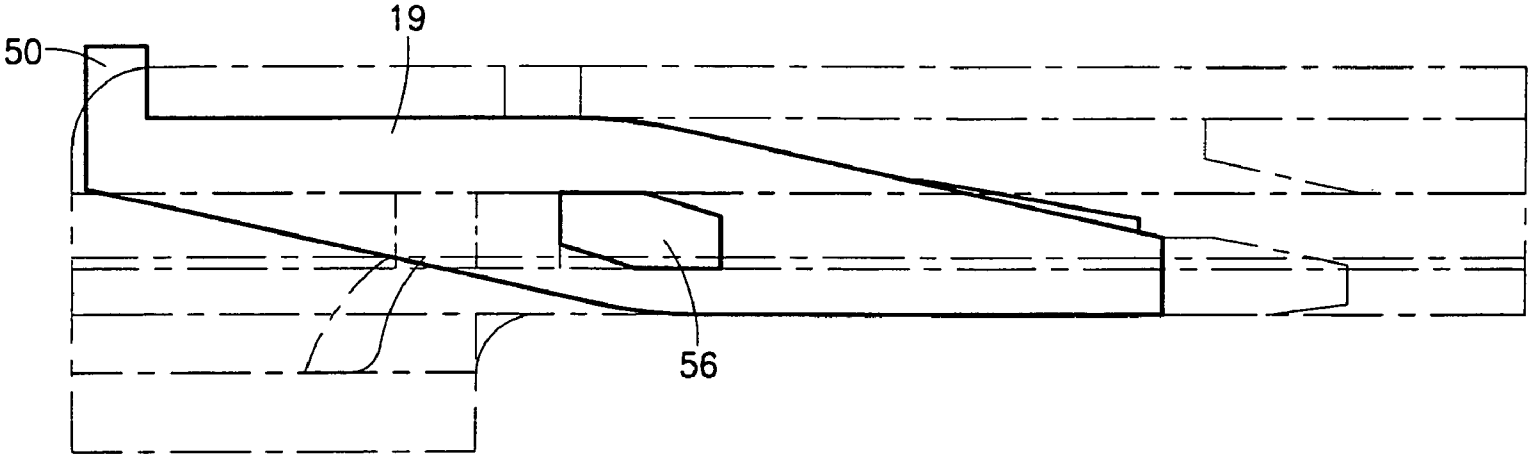
FIG. 10 is an illustrative side view showing the CPA member at the neutral unlocked position.
Figure 11:
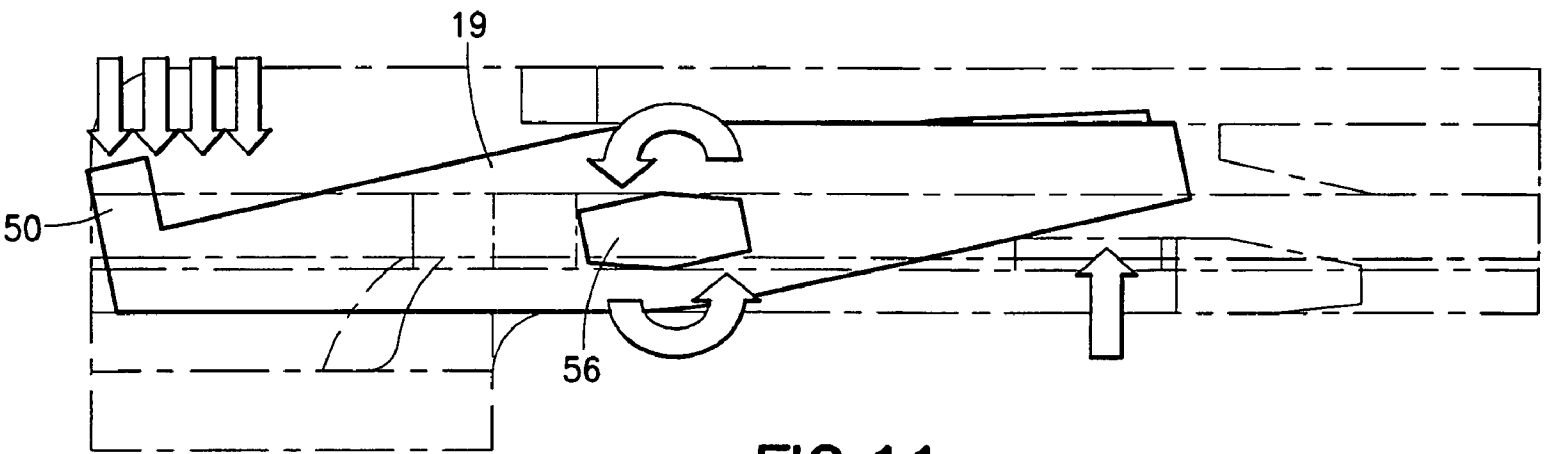
FIG. 11 is an illustrative side view as in FIG. 10 showing the CPA member pivoted to an unlatching position.

As noted above, the CPA lugs 56 are slidably located in the grooves 42. The CPA lugs 56 are sized and shaped to allow the CPA member to pivot or rotate in the grooves 42 when the CPA member is at its rearward unlocked position. In particular, referring also to FIGS. 10-11, the CPA member 19 is normally held in the front down position shown in FIG. 10 by the latch 28; the latch lugs 56 against the bottom side 62 in the CPA member's groove 58. However, as seen with reference to FIG. 11, when the CPA member is in the rear unlocked position, a user can push downward at the finger contact section 50 to rotate or pivot the CPA member. The front end of the CPA member is able to rotate outwardly upward. Because of contact between the latch lugs 56 against the bottom side 62 in the CPA member's groove 58, the CPA member is able to move the latch lugs 56 outwardly upward, thus moving the bridge 34 and locking surface 40 outwardly upward. This disengages the locking surface 40 from the latch 20 to allow the two electrical connectors to be disconnected from each other.

With the invention, the CPA member can perform two function. In its forward locked position, the CPA member can function as a CPA to insure that the latch 28 does not inadvertently disengage from the latch 20 of the mating electrical connector. In its rearward unlocked position, the CPA member can function as a latch release to move the latch 28 to an unlatch position for disconnecting the electrical connectors from each other.

Figure 13:
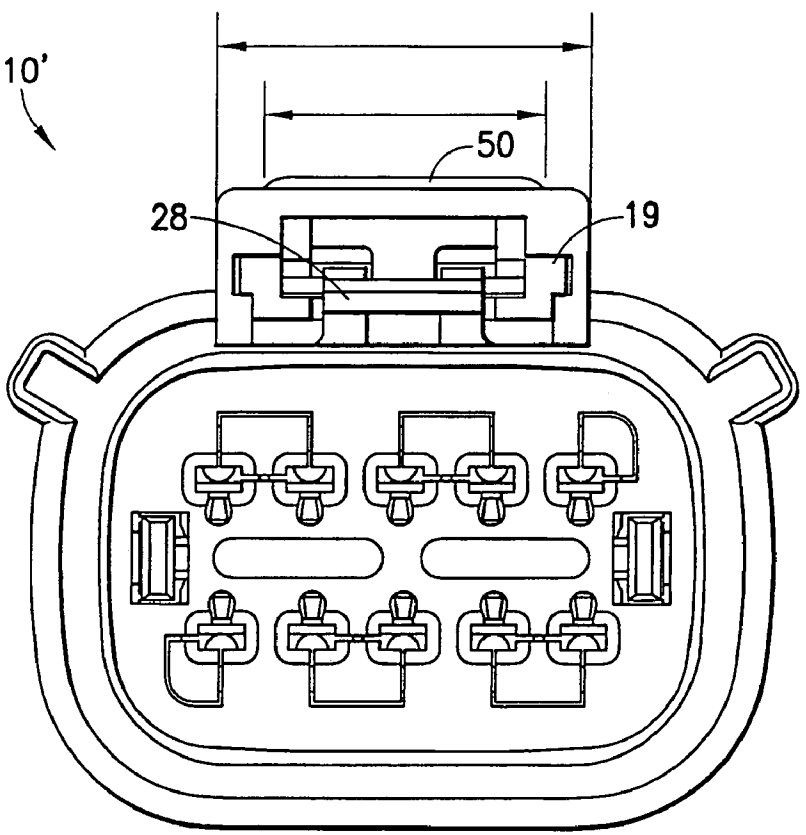
FIG. 13 is a front side view of a female electrical connector of the invention.
Figure 12:
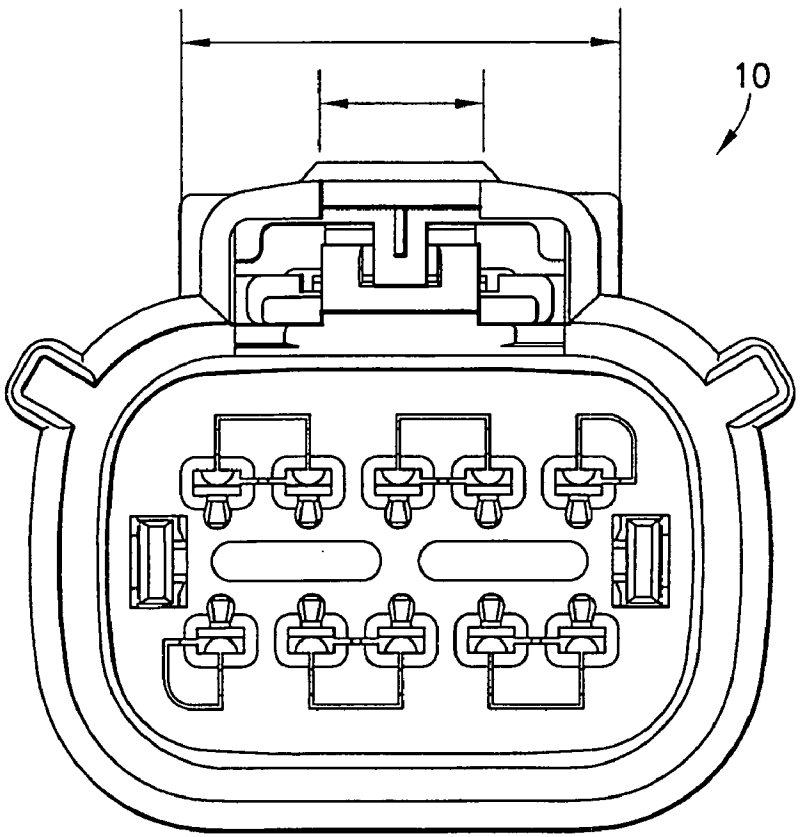
FIG. 12 PRIOR ART
FIG. 12 is a front side view of the female electrical connector shown in FIG. 1.

Referring also to FIGS. 12-13, with the invention the electrical connector 10' can have a smaller overall size than the conventional electrical connector 10, but with a larger, more ergonomic actuation surface at the finger contact section 50. The CPA member can bias the latch into open and closed positions. The CPA member is slidably between two positions and is rotatable at the second position. The L-shaped ends of the front of the CPA side arms can lift the lugs on the latch to deflect the front end of the latch upward. This can unlock the connectors. When the CPA member is fully retracted, but not depressed, the latch is free so it can mate with the mating electrical connector. The front end of the latch can be deflected outward by the latch of the mating electrical connector without deflecting the CPA member. When the CPA member is fully moved forward, the CPA member can bias the latch in the mated position. Thus, the CPA member is a multi-function CPA (MFCPA).

With the invention, the grooves 42 in the housing 14' provide sliding guidance and rotational pivot support for the MFCPA. The backstop with stop surface 44 prevents removal of the MFCPA through the back of the housing 14'. Lugs on sides of the latch interact with the MFCPA, and stops 48 of the housing 14' at the front ends of the grooves 42 prevent the MFCPA from rotating in the forward locked position. The MFCPA cannot be pushed forward to its locked position unless its center arm is first moved by the latch of the mating electrical connector. The side arms of the MFCPA reinforce the arms of the latch because of the location of the latch lugs in the CPA grooves when the MFCPA is in its forward position. The CPA lugs can function as fulcra for a mechanical advantage when moving the latch outward. The rear lip on the finger contact section of the CPA member allows the CPA member to be pulled back from its locked position. The large ergonomic actuation surface of the finger contact surface 50 makes the MFCPA relatively easy to actuate.

When the MFCPA is at its forward locked position, the center arm of the MFCPA prevents the latch from flexing because of the location of the center arm on top of the bridge and the interlocking of the latch with the MFCPA. When the MFCPA is in the forward locked position, the actuation surface of the MFCPA at the finger contact section is made inaccessible by the cover section 30 of the housing 14', but the CPA's lip is exposed for a user to pull the MFCPA back into its neutral of unlocked position. Both the MFCPA and the latch can be easily molded without any thin sections. Both components can be molded using line-of-draw tooling. Therefore, no complex mechanisms like slides or lifter are required in the manufacturing machines. Moving the disconnection actuation surface to the MFCPA allows the latch 28 to be designed for strength. It does not need to be designed for a teeter-totter movement such as in U.S. Pat. No. 6,921,279. The disconnect actuation surface is well protected after the MFCPA is moved to its locked position. The invention can be used with sealed and unsealed connector applications. The CPA and latch are protected from inadvertent disconnection by the fact that they are substantially inaccessible when the CPA is slid forward into the locked position and the CPA cannot be rotated at the forward position.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector comprising:

at least one electrical contact;

a housing having a latch for latching the housing to a mating electrical connector, wherein the electrical contact is located in the housing; and a connector position assurance (CPA) member connected to the housing, wherein the CPA member is adapted to prevent the latch from moving when the housing is mated with the mating electrical connector, and wherein the CPA member is adapted to move the latch after the housing is mated with the mating electrical connector away from a latching position towards an unlatched position, wherein the CPA member is adapted to pivot on the housing.

2. An electrical connector as in claim 1 wherein the CPA member is movably mounted on the housing between an unlocked position and a locked position, and wherein the CPA member is adapted to pivot on the housing at the unlocked position.

3. An electrical connector as in claim 1 wherein the CPA member comprises laterally extending pivot lugs slidably located in grooves of the housing.

4. An electrical connector as in claim 1 wherein the CPA member is pivotably and slidably connected to the housing, and wherein the housing is adapted to prevent the CPA member from pivoting when the CPA member is at a locked position.

5. An electrical connector as in claim 1 further comprising means for making the CPA member and the latch substantially inaccessible when the CPA member is located at a locked position.

6. An electrical connector as in claim 1 wherein the CPA member comprises front latch contact surfaces located at a front of the CPA member contacting portions of the latch.

7. An electrical connector as in claim 6 wherein the portions of the latch comprise laterally outwardly extending lugs on the latch.

8. An electrical connector comprising:

at least one electrical contact;

a housing having a latch for latching the housing to a mating electrical connector, wherein the electrical contact is located in the housing; and a connector position assurance (CPA) member connected to the housing, wherein the CPA member is adapted to prevent the latch from moving when the housing is mated with the mating electrical connector, and wherein the CPA member is adapted to move the latch after the housing is mated with the mating electrical connector, wherein the CPA member comprises inwardly facing slots adapted to receive portions of the latch when CPA member is at a locked position on the housing.

9. An electrical connector comprising:

at least one electrical contact;

a housing having a latch for latching the housing to a mating electrical connector, wherein the electrical contact is located in the housing; and a connector position assurance (CPA) member connected to the housing, wherein the CPA member is adapted to prevent the latch from moving when the housing is mated with the mating electrical connector, and wherein the CPA member is adapted to move the latch after the housing is mated with the mating electrical connector away from a latching position towards an unlatched position, wherein the latch comprises laterally outwardly extending lugs on the latch.

10. An electrical connector comprising:

at least one electrical contact;

a housing having a latch for latching the housing to a mating electrical connector, wherein the electrical contact is located in the housing; and a connector position assurance (CPA) member connected to the housing, wherein the CPA member is adapted to rotate on the housing at lateral side pivots of the CPA member proximate a middle of the CPA member.

11. An electrical connector as in claim 10 wherein the CPA member comprises inwardly facing slots adapted to receive portions of the latch when CPA member is at a locked position on the housing.

12. An electrical connector as in claim 10 wherein the latch comprises laterally outwardly extending cantilevered lugs on the latch.

13. An electrical connector as in claim 10 wherein the lateral side pivots comprise outwardly extending pivot posts.

14. An electrical connector as in claim 13 wherein the CPA member is adapted to slide along the housing on the pivot posts.

15. An electrical connector as in claim 10 wherein the CPA member is adapted to slide along the housing between an unlocked position and a locked position.

16. An electrical connector as in claim 15 wherein the CPA member is adapted to prevent the latch from moving when the housing is mated with the mating electrical connector and the CPA member is moved to the locked position.

17. An electrical connector as in claim 15 wherein the CPA member is adapted to move the latch to an unlatched position when the CPA member is in the unlocked position.

18. An electrical connector as in claim 15 wherein the CPA member is adapted to pivot on the housing at the unlocked position and the housing is adapted to prevent the CPA member from pivoting at the locked position.

19. An electrical connector as in claim 10 wherein the CPA member comprises front latch contact surfaces located at a front of the CPA member contacting portions of the latch.

20. An electrical connector as in claim 19 wherein the portions of the latch comprise laterally outwardly extending lugs on the latch.

21. An electrical connector comprising:

at least one electrical contact;

a housing having a latch for latching the housing to a mating electrical connector, wherein the electrical contact is located in the housing, and wherein the latch comprises cantilevered lugs extending from opposite lateral sides of the latch; and a connector position assurance (CPA) member connected to the housing, wherein the CPA member contacts the lugs of the latch, wherein fronts of the grooves have an open top side and a closed bottom side such that, when the CPA member is in an unlocked position, the latch can move upward relative to the CPA member and the CPA member can move the latch upward by moving the lugs upward at the closed bottom side.

22. An electrical connector as in claim 21 wherein the CPA member comprises grooves which lockingly receive the lugs when the CPA member is in a locked position to prevent the latch from moving relative to the CPA member.

23. An electrical connector comprising:

at least one electrical contact;

a housing having a latch for latching the housing to a mating electrical connector, wherein the electrical contact is located in the housing; and a connector position assurance (CPA) member connected to the housing, wherein the CPA member is adapted to deflect the latch to disconnect the latch from the mating electrical connector, wherein the CPA member comprises laterally extending lugs located into grooves of the housing, and wherein the latch comprises laterally extending lugs extending into grooves of the CPA member.

24. A method of assembling an electrical connector comprising:

inserting a connector position assurance (CPA) member into a housing of the electrical connector;

locating laterally extending pivot lugs of the CPA member in grooves of the housing; and locating laterally extending connection lugs of a latch of the housing at generally opposite contact surfaces of the CPA member.

25. An electrical connector comprising:

at least one electrical contact;

a housing having a latch for latching the housing to a mating electrical connector, wherein the electrical contact is located in the housing; and a connector position assurance (CPA) member connected to the housing, wherein the CPA member is adapted to deflect the latch to disconnect the latch from the mating electrical connector, wherein the CPA member is adapted to slide on the housing, and wherein the CPA member is adapted to at least partially rotate relative to the housing.

* * * * *